US009916804B2

(12) United States Patent
Jeon et al.

(10) Patent No.: US 9,916,804 B2
(45) Date of Patent: Mar. 13, 2018

(54) DISPLAY APPARATUS AND METHOD OF DRIVING THE DISPLAY APPARATUS

(71) Applicant: SAMSUNG DISPLAY CO., LTD., Yongin, Gyeonggi-Do (KR)

(72) Inventors: Jae-Gwan Jeon, Incheon (KR); Jae-Hyoung Park, Suwon-si (KR); Ki-Tae Yoon, Seoul (KR); Dong-Won Park, Asan-si (KR); Young-Soo Sohn, Guri-si (KR); Won-Bok Lee, Seongnam-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 157 days.

(21) Appl. No.: 14/697,996

(22) Filed: Apr. 28, 2015

(65) Prior Publication Data

US 2016/0111051 A1 Apr. 21, 2016

(30) Foreign Application Priority Data

Oct. 16, 2014 (KR) ..... 10-2014-0139777

(51) Int. Cl.
*G09G 3/36* (2006.01)

(52) U.S. Cl.
CPC ..... *G09G 3/3674* (2013.01); *G09G 2310/08* (2013.01); *G09G 2320/0223* (2013.01)

(58) Field of Classification Search
CPC ..... G09G 2310/08; G09G 2320/0223; G09G 3/3674
See application file for complete search history.

(56) References Cited

U.S. PATENT DOCUMENTS 5,614,922 A * 3/1997 Kawaguchi ..... G09G 3/2011 345/100
2004/0100435 A1* 5/2004 Baek ..... G09G 3/3677 345/98
2006/0267879 A1* 11/2006 Lee ..... G09G 3/22 345/75.2
2006/0284815 A1* 12/2006 Kwon ..... G09G 3/3614 345/98
2008/0211790 A1* 9/2008 Jung ..... G09G 3/3688 345/204
2010/0231559 A1* 9/2010 Ooga ..... G09G 3/20 345/205
2011/0007068 A1* 1/2011 Okutani ..... G09G 3/296 345/214

(Continued)

FOREIGN PATENT DOCUMENTS

KR 1020030026589 4/2003
KR 1020040006251 1/2004

(Continued)

*Primary Examiner* — Afroza Chowdhury
(74) *Attorney, Agent, or Firm* — F. Chau & Associates, LLC

(57) ABSTRACT

A display apparatus includes a display panel comprising a plurality of gate lines and a plurality of data lines, a gate driver circuit configured to generate a plurality of gate signals sequentially applied to the gate lines, and a timing controller configured to generate a reference control signal, the reference control signal adjusting at least one of a pulse-width and a phase of a predetermined gate signal among the gate signals.

15 Claims, 10 Drawing Sheets

(56) References Cited

U.S. PATENT DOCUMENTS

| | | | | |
|---|---|---|---|---|
| 2013/0050176 | A1* | 2/2013 | Kim | G09G 3/36 345/214 |
| 2013/0215090 | A1* | 8/2013 | Kim | G09G 3/3648 345/204 |

FOREIGN PATENT DOCUMENTS

| | | |
|---|---|---|
| KR | 1020070121337 | 12/2007 |
| KR | 1020120071909 | 7/2012 |

* cited by examiner

DISPLAY APPARATUS AND METHOD OF DRIVING THE DISPLAY APPARATUS

CROSS-REFERENCE TO RELATED APPLICATION(S)

This application claims priority under 35 U.S.C. § 119 to Korean Patent Application No. 10-2014-0139777, filed on Oct. 16, 2014 in the Korean Intellectual Property Office, the disclosure of which is incorporated by reference in its entirety herein.

BACKGROUND

1. Technical Field

Exemplary embodiments of the inventive concept relate to a display apparatus and a method of driving the display apparatus.

2. Discussion of Related Art

Generally, a liquid crystal display (LCD) apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes to the light transmittance characteristics of the liquid crystals.

The liquid display panel includes an array substrate which has a plurality of gate lines, a plurality of data lines, a plurality of thin film transistors and corresponding pixel electrodes. The liquid display panel also includes an opposing substrate which has a common electrode. A liquid crystal layer is interposed between the array substrate and opposing substrate. The driving circuit includes a gate driving part which drives the gate lines of the array substrate and a data driving part which drives the data lines.

A resistance-capacitance (RC) time delay factor can delay the gate signals transferred through the gate lines and the data signals transferred through the data lines. The RC time delay may have its greatest effect on portions of the display area farthest away from the gate driving part that output the gate signals. The gate signals control a charging period during which respective data signals are charged into the pixels of a given row. When a gate signal switches to the off state, charging stops. As a result, a charging ratio may be decreased unnecessarily by increased RC time delays experienced by some of the gate signals.

Therefore, a lower quality display, with dimmer luminance, color mixing, ghosting, etc., may occur due to the effects of the increased RC time delay.

BRIEF SUMMARY

At least one embodiment of the inventive concept provides a display apparatus for removing a local charging difference due to a discontinuous load change.

At least one exemplary embodiment of the inventive concept provides a method of driving the display apparatus.

According to an exemplary embodiment of the inventive concept, there is provided a display apparatus. The display apparatus includes a display panel comprising a plurality of gate lines and a plurality of data lines, a gate driver circuit configured to generate a plurality of gate signals sequentially applied to the gate lines, and a timing controller configured to generate a reference control signal to adjust at least one of a pulse-width and a phase of a predetermined gate signal among the gate signals. The data lines may cross the gate lines.

In an exemplary embodiment, the reference control signal may gradually adjust at least one of pulse-widths and phases of the predetermined gate signal and the gate signals adjacent to the predetermined gate signal.

In an exemplary embodiment, the timing controller may include a first reference control signal generator configured to generate a first reference control signal based on a data enable signal, a masking signal generator configured to generate a masking signal having a rising masking pulse and a falling masking pulse, and a second reference control signal generator configured to perform an operation on the first reference control signal and the masking signal to generate a second reference control signal locally adjusted with respect to the first reference control signal.

In an exemplary embodiment, the second reference control signal generator may be configured to perform an OR operation or an XOR operation on a rising period of the first reference control signal and the rising masking pulse and to perform an OR operation or an XOR operation on a falling period of the first reference control signal and the falling masking pulse.

In an exemplary embodiment, a horizontal blanking period of the data enable signal may be delayed based on an RC time delay of a data line.

In an exemplary embodiment, the timing controller may include a horizontal line counter configured to output a horizontal line count value corresponding to a predetermined gate line receiving the predetermined gate signal, and a memory configured to store a rising parameter for generating the rising masking pulse and a falling parameter for generating the falling masking pulse.

In an exemplary embodiment, the rising parameter and the falling parameter may be preset to compensate for a charging rate difference in a predetermined area corresponding to the predetermined gate line.

In an exemplary embodiment, the gate driver circuit may be configured to generate a gate signal having an early period overlapping with a late period of a previous gate signal, and the timing controller may be configured to generate the second reference control signal gradually adjusting at least one of pulse-widths and phases of a first gate signal applied to a first gate line and an adjacent gate signal applied to at least one gate lines adjacent to the first gate line.

In an exemplary embodiment, the display panel is divided into an upper area and a lower area, a plurality of first data lines is disposed in the upper area, a plurality of second data lines spaced apart from the first data lines is disposed in the lower area, and the timing controller is configured to generate the second reference control signal gradually adjusting at least one of pulse-widths and phases of a predetermined gate signal applied to a predetermined gate line in a boundary area being between the upper and lower areas and an adjacent gate signal applied to at least one gate line adjacent to the predetermined gate line.

According to an exemplary embodiment of the inventive concept, there is provided a method of driving a display apparatus. The method includes generating a reference control signal, generating a predetermined gate signal applied to a predetermined gate line, and adjusting at least one of a pulse-width and a phase of the predetermined gate signal applied to the predetermined gate line using the reference control signal.

In an exemplary embodiment, the reference control signal may gradually adjust at least one of pulse-widths and phases of the predetermined gate signal and at least one gate signal adjacent to the predetermined gate signal.

In an exemplary embodiment, the method may further include generating a first reference control signal based on a data enable signal, generating a masking signal having a rising masking pulse and a falling masking pulse, and performing an operation on the first reference control signal and the masking signal to generate a second reference control signal locally adjusted with respect to the first reference control signal.

In an exemplary embodiment, the method may further include performing an OR or XOR operation on a rising period of the first reference control signal, and performing an OR or XOR operation on a falling period of the first reference control signal and the falling masking pulse.

In an exemplary embodiment, a horizontal blanking period of the data enable signal may be delayed based on an RC time delay of a data line.

In an exemplary embodiment, the method may further include outputting a horizontal line count value corresponding to the predetermined gate line receiving the predetermined gate signal, outputting a rising parameter and a falling parameter corresponding to the predetermined gate line from a memory based on the horizontal line count value, and generating the masking signal using the rising parameter and the falling parameter.

In an exemplary embodiment, the rising parameter and the falling parameter may be preset to compensate for a charging rate difference in a predetermined area corresponding to the predetermined gate line.

In an exemplary embodiment, the method may further include generating a gate signal having an early period overlapping with a late period of a previous gate signal, wherein the second reference control signal may gradually adjust at least one of pulse-widths and phases of a first gate signal applied to a first gate line and an adjacent gate signal applied to at least one gate lines adjacent to the first gate line.

In an exemplary embodiment, a display panel may be divided into an upper area and a lower area, a plurality of first data lines is disposed in the upper area, a plurality of second data lines spaced apart from the first data lines is disposed in the lower area, and the second reference control signal may gradually adjust at least one of pulse-widths and phases of a predetermined gate signal applied to a predetermined gate line in a boundary area between the upper and lower areas and an adjacent gate signal applied to at least one gate line adjacent to the predetermined gate line.

According to an exemplary embodiment of the inventive concept, a timing controller for a display apparatus is provided. The timing controller includes a first signal generator configured to generate a first reference control signal, a second signal generator configured to generate a masking signal, and a third signal generator configured to perform an OR operation on a first pulse of the masking signal and the first reference control signal, to generate a second reference control signal for synchronization with a gate signal applied to a gate line of the display apparatus. In an embodiment, the third signal generator is configured to perform the OR operation on a third pulse of the masking signal and the first reference control signal, and perform the XOR operation on a fourth pulse of the masking signal and the first reference control signal, to generate the second reference control signal, where a width of the third pulse is less than the first pulse and a width of the fourth pulse is less than the second pulse.

According to at least one embodiment of the inventive concept, the reference control signal controlling the gate signal is locally adjusted corresponding to a predetermined horizontal line having a luminance difference to locally adjust the charge rate difference of the predetermined horizontal line such that a display defect due to the luminance difference may be removed.

BRIEF DESCRIPTION OF THE DRAWINGS

The inventive concept will become more apparent by describing detailed exemplary embodiments thereof with reference to the accompanying drawings, in which.

DETAILED DESCRIPTION

Hereinafter, the inventive concept will be explained in detail with reference to the accompanying drawings.

Figure 1:
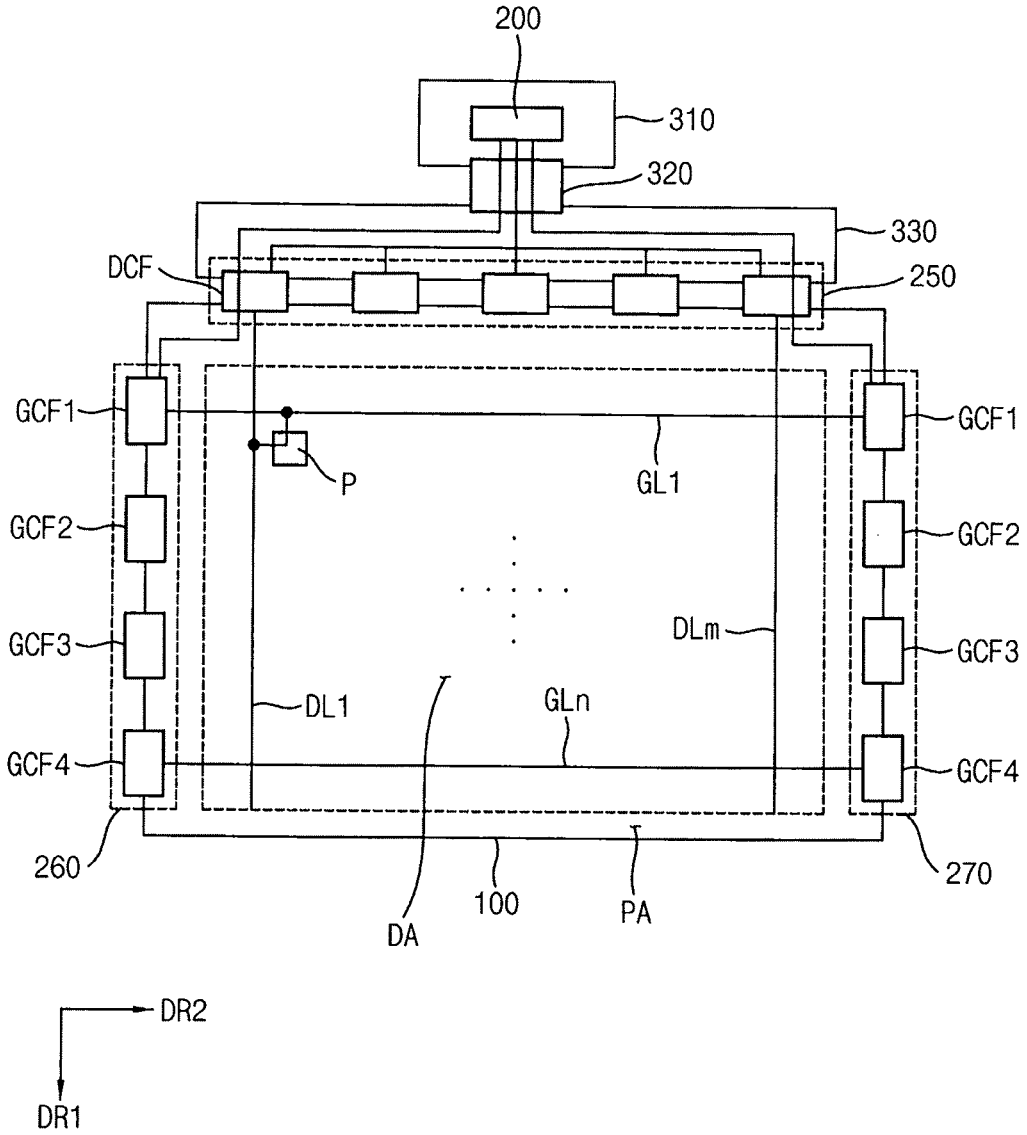
FIG. 1 is a plan view illustrating a display apparatus according to an exemplary embodiment of the inventive concept.

FIG. 1 is a plan view illustrating a display apparatus according to an exemplary embodiment of the inventive concept.

Referring to FIG. 1, the display apparatus includes a display panel 100, a timing controller 200, a data driver circuit 250, a first gate driver circuit 260 and a second gate driver circuit 270.

The display apparatus may further include a control circuit board 310, at least one circuit film 320 and at least one source circuit board 330. The timing controller 200 may be disposed on the control circuit board 310. A first end portion of the circuit film 320 is connected to the control circuit board 310 and a second end portion of the circuit film 320 is connected to the source circuit board 330. An end portion of the data driver circuit 250 is connected to the source circuit board 330.

The display panel 100 includes a display area DA and a peripheral area PA surrounding the display area DA. A plurality of pixels P, a plurality of data lines DL and a plurality of gate lines GL are disposed in the display area DA. The data driver circuit 250, the first gate driver circuit 260 and the second gate driver circuit 270 are disposed in the peripheral area PA.

The pixels P may be arranged as a matrix type which includes a plurality of pixel columns and a plurality of pixel rows. Each of the pixel columns includes pixels arranged in the first direction DR1. Each of the pixel rows includes pixels arranged in second direction DR2 crossing the first direction DR1.

The data lines DL1, . . . , DLm extend in the first direction DR1 and are arranged in the second direction DR2. Each of the data lines DL1, . . . , DLm is connected to the pixels in a corresponding pixel column and is configured to transfer a data signal to the pixels in the corresponding pixel column.

The gate lines GL1, . . . , GLn extend in the second direction DR2 and are arranged in the first direction DR1. Each of the gate lines GL1, . . . , GLn is connected to the pixels in a corresponding pixel row and is configured to transfer a gate signal to the pixels in the corresponding pixel row.

Each of the pixels P may include a switching element which is connected to a gate line GL1 and a data line DL1 and a display element which is connected to the switching element. The display element may include an LC capacitor, an organic light emitting element, etc.

The timing controller 200 is configured to control the data driver circuit 250, the first gate driver circuit 260 and the second gate driver circuit 270.

The timing controller 200 is configured to correct a data signal by utilizing various compensation algorithms, and then provide the data driver circuit 250 with a corrected data signal. The timing controller 200 is configured to generate a data control signal for controlling the data driver circuit 250 and a gate control signal for controlling the first and second gate driver circuits 260 and 270.

The data control signal may include a data synchronization (sync) signal which includes a horizontal sync signal and a vertical sync signal and a load signal which controls an output timing of the data signal. The gate control signal may include a reference control signal. The reference control signal is configured to control at least one of a pulse-width and a phase of the gate signal. According to an exemplary embodiment of the inventive concept, at least one of the pulse-width and the phase of the reference control signal are adjusted such that a charging rate difference according to a phase difference between the data signal and the gate signal is compensated. Thus, a local luminance difference due to a charging rate difference between adjacent horizontal lines may be removed.

The data driver circuit 250 includes a plurality of data circuit films DCF. Each of the data circuit films DCF includes a data driver chip which drives a data line. The data circuit films DCF connect to the source circuit board 330 and the display panel 100. The data circuit films DCF adjacent to the first and second gate driver circuits 260 and 270 transfer the gate control signal received from the control circuit board 310 to the first and second gate driver circuits 260 and 270. For example, the first one of the data circuit films DCF may be used to transfer the gate control signal to the first gate driver circuit 260 and the last one of the data circuit films DCF may be used to transfer the gate control signal to the second gate driver circuit 270.

The data driver circuit 250 is configured to drive the data lines DL1, . . . , DLm based on the data control signal and the data signals received from the timing controller 200.

The first gate driver circuit 260 includes a plurality of gate circuit films GCF1, . . . , GCF4. Each of the gate circuit films GCF1, . . . , GCF4 includes a gate driver chip for driving a gate line. The first gate driver circuit 260 is disposed in the peripheral area PA adjacent to a first end portion of the gate line. The second gate driver circuit 270 includes a plurality of gate circuit films GCF1, . . . , GCF4. Each of the gate circuit films GCF1, . . . , GCF4 includes a gate driver chip for driving a gate line. The second gate driver circuit 270 is disposed in the peripheral area PA adjacent to a second end portion of the gate line.

Each of the first and second gate driver circuits 260 and 270 is configured to sequentially drive the gate lines GL1, . . . , GLn based on the gate control signal received from the timing controller 200. According to an exemplary embodiment of the inventive concept, each of the first and second gate driver circuits 260 and 270 are configured to generate the gate signal synchronized with the reference control which has at least one its phase and the pulse-width locally adjusted. In an exemplary embodiment, synchronization means that a pulse of the gate signal starts when a pulse of the reference control signal starts, or that the pulse of the gate signal starts and ends when a pulse of the reference control signal starts and ends.

In the exemplary embodiment of the inventive concept, at least one of the phase and the pulse-width of the reference control signal which is the gate control signal, are locally adjusted and thus, a local luminance difference due to a charging rate difference which occurs between adjacent horizontal lines may be removed.

Figure 2:
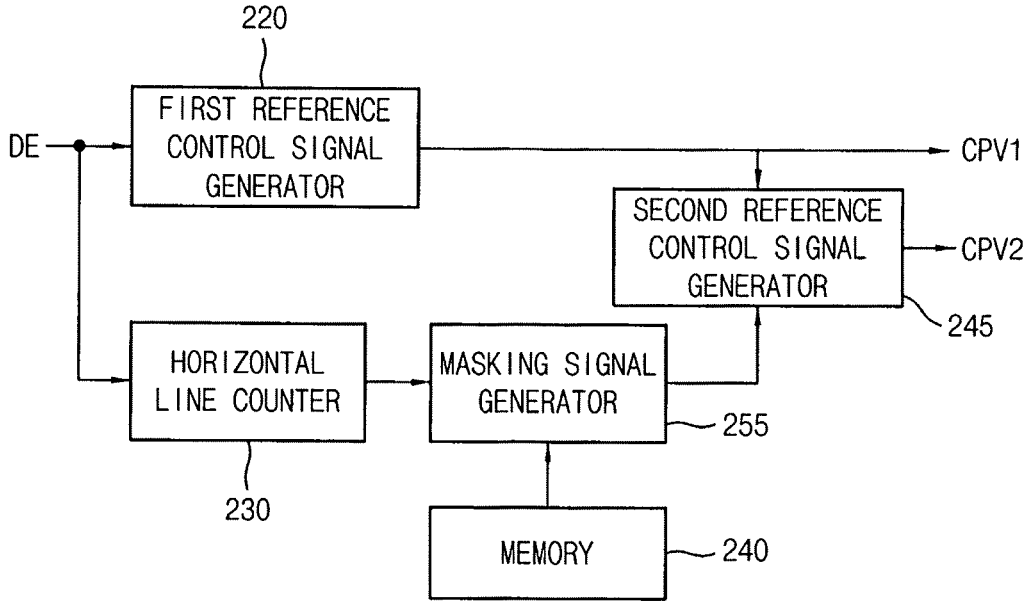
FIG. 2 is a block diagram illustrating a timing controller of FIG. 1 according to an exemplary embodiment of the inventive concept.
Figure 3:
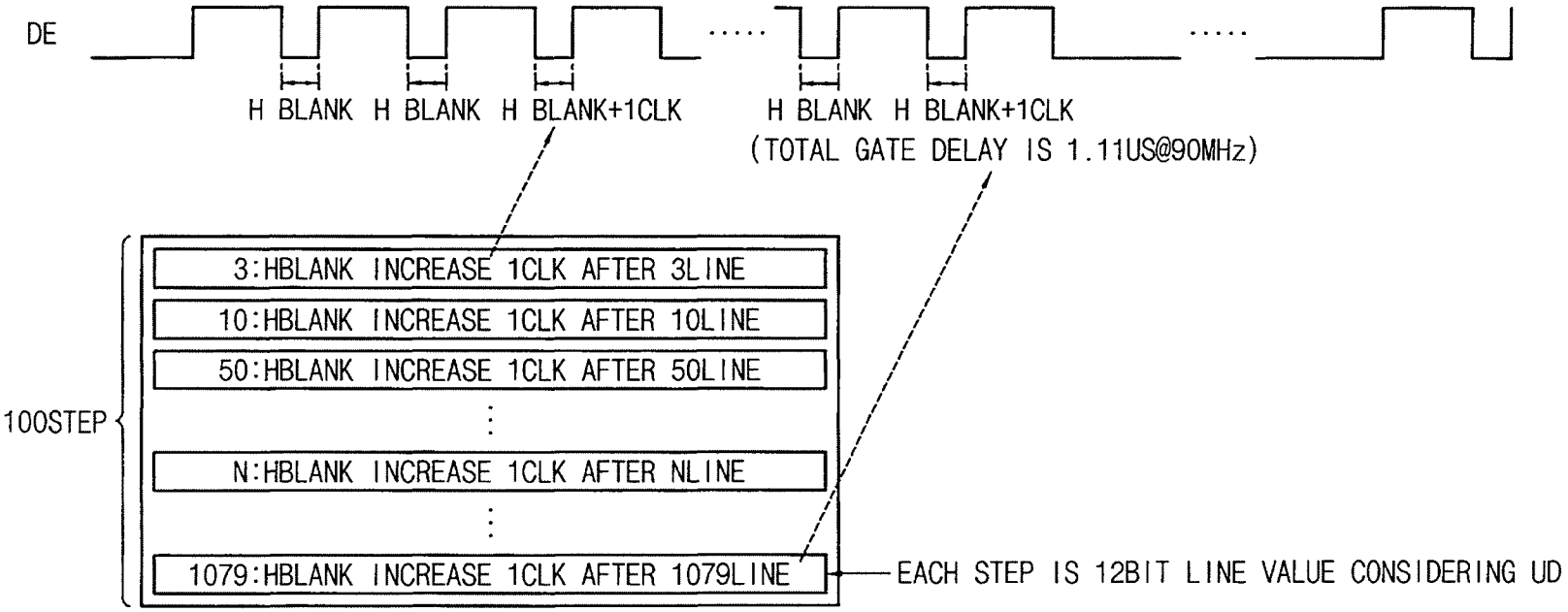
FIG. 3 is a waveform diagram illustrating a data enable signal of FIG. 2.
Figure 4A:
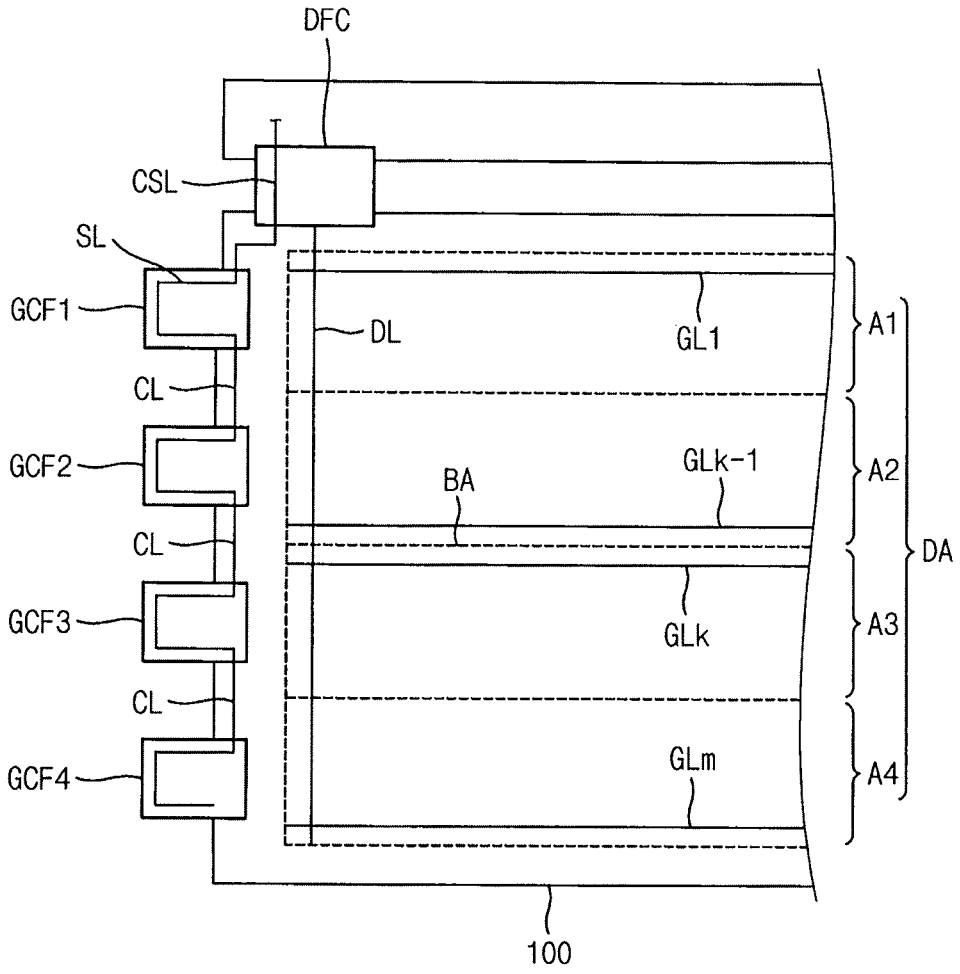
FIGS. 4A and 4B are conceptual diagrams illustrating a luminance according to a charging rate of a horizontal line.
Figure 4B:
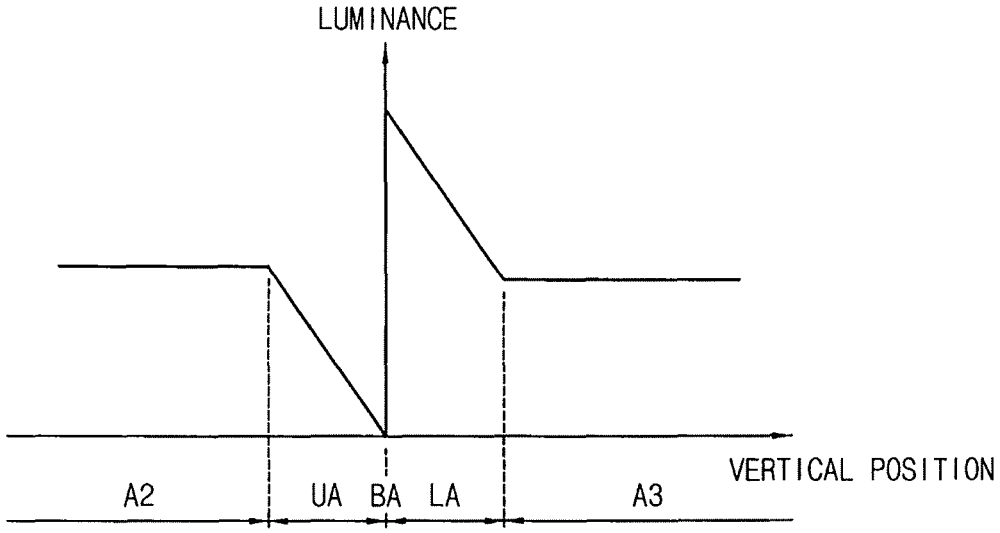

FIG. 2 is a block diagram illustrating a timing controller of FIG. 1. FIG. 3 is a waveform diagram illustrating a data enable signal of FIG. 2. FIGS. 4A and 4B are conceptual diagrams illustrating a luminance according to a charging rate of a horizontal line.

Referring to FIGS. 1 and 2, the timing controller 200 includes a first reference control signal generator 220, a horizontal line counter 230, a memory 240, a masking signal generator 255 and a second reference control signal generator 245.

The first reference control signal generator 220 is configured to generate a first reference control signal CPV1 based on the data enable signal DE.

The data driver circuit 250 is disposed on the display panel 100, and is configured to output the data signal to the data line DL. When the data signal is applied to a single end portion of the data line corresponding to an upper area of the display panel 100, the data signal transferred to a lower area of the display panel 100 is delayed by an RC time delay. Thus, the gate signal which is applied to the gate line disposed in the lower area has a phase difference with the data signal. When the gate signal which is applied to the gate line disposed in the lower area is delayed by the RC time delay of the data signal, a charging rate due to the phase difference between the gate signal and the data signal in the lower area may be compensated.

According to an exemplary embodiment of the inventive concept, a horizontal blanking period of the data enable signal increases based on the RC time delay of the data signal, which increases toward the lower area of the display panel. The amount that a length or ending position of the horizontal blanking period is increased based on the RC time delay of the data signal may be adjusted.

For example, as shown in FIG. 3, a delay of a data enable signal DE for a display panel having an Ultra Definition (UD) resolution may be adjusted by 100 steps or clocks. The horizontal blanking period HBLANK of the data enable signal DE respectively corresponding to third, 10-th, 50-th, . . . N-th, . . . 1079-th horizontal lines is increased by a duty of one clock 1 CLK. Thus, the delay of the horizontal blanking period HBLANK corresponding to the 1079-th horizontal line is accumulated and thus, is delayed by a duty of 100 clocks.

The first reference control signal generator 220 is configured to generate the first reference control signal CPV1 using the data enable signal DE delayed based on the RC time delay as shown in FIG. 3. Thus, the RC time delay is reflected in the first reference control signal CPV1.

The horizontal line counter 230 is configured to count the data enable signal DE corresponding to the horizontal line and to provide the masking signal generator 255 with a horizontal line count value. For example, each period of the data enable signal DE including a logic high pulse followed by a logic low period may correspond to distinct horizontal line of the display. For example, the horizontal line counter 230 can increment a counter each time it observes in the data enable signal DE a logic high pulse or the logic high pulse followed a logic low period that corresponds to the current horizontal line.

The memory 240 is configured to store a masking parameter corresponding to a predetermined horizontal line of the display panel 100. The masking parameter includes a rising parameter for masking a rising period of the first reference control signal CPV1 and a falling parameter for masking a falling period of the first reference control signal CPV1.

The masking signal generator 255 is configured to generate a masking signal MS using the masking parameter of the predetermined horizontal line stored in the memory 240 based on the horizontal line count value. The masking signal MS includes a rising masking pulse corresponding to the rising parameter and a falling masking pulse corresponding to the falling parameter.

The second reference control signal generator 245 is configured to perform a calculation on the first reference control signal CPV1 and the masking signal MS corresponding to the predetermined horizontal line via an OR operation and a XOR operation to generate a second reference control signal CPV2, which has at least one of its pulse-width and phase adjusted corresponding to the predetermined horizontal line. The predetermined horizontal line may be determined by the horizontal line counter 230.

For example, the second reference control signal generator 245 is configured to perform a calculation on a rising period of the first reference control signal CPV1 and a rising masking pulse of the masking signal MS via the OR or XOR operation, and to perform a calculation on a falling period of the first reference control signal CPV1 and a falling masking pulse of the masking signal MS via the OR or XOR operation. The rising or falling period of the second reference control signal CPV2 may be increased through the OR operation, and the rising or falling period may be decreased through the XOR operation.

In addition, when the falling periods of the rising and falling masking pulses are synchronized with the rising periods of the first reference control signal CPV1, the phase of the second reference control signal CPV2 is shifted to the left. When the rising periods of the rising and falling masking pulses are synchronized with the rising period of the first reference control signal CPV1, the phase of the second reference control signal CPV2 is shifted to the right.

In addition, the pulse width of each of the rising masking pulse and the falling masking pulse may be adjusted so that the pulse width of the second reference control signal CPV2 is adjusted.

As described above, the second reference control signal generator 245 is configured to provide the first and second gate driver circuits 260 and 270 with the second reference control signal CPV2. The first and second gate driver circuits 260 and 270 are configured to generate the gate signal having its pulse-width and phase synchronized with the second reference control signal CPV2 and to output gate signals to the gate lines.

Therefore, a charging rate difference which locally occurs on the predetermined horizontal line of the display panel 100 may be removed due to the second reference control signal having at least one of the pulse-width and the phase adjusted using the masking parameter corresponding to the predetermined horizontal line.

Hereinafter, a luminance difference which occurs due to a charging rate difference of a predetermined horizontal line will be explained as an example.

Referring to FIGS. 4A and 4B, a display area DA of the display panel 100 is divided into first to fourth areas A1, A2, A3 and A4 by the gate circuit films GCF1, . . . , GCF4 which drive the gate lines GL1, . . . , GLn. The first to fourth areas A1, A2, A3 and A4 may be respectively driven by the gate circuit films GCF1, . . . , GCF4.

Each of the gate driver chips disposed on the gate circuit films GCF1, . . . , GCF4 is configured to generate a plurality of gate signals based on the gate control signal received from the timing controller 200 and to sequentially provide the gate lines in the corresponding area with the gate signals.

The gate control signal is transferred to the gate driver chips on the gate circuit films GCF1, . . . , GCF4 through a control signal line CSL. The control signal line CSL includes a signal line SL which is disposed on or within the gate circuit films GCF1, . . . , GCF4 and a connection line CL which is directly disposed on or within the display panel 100.

A load of the connection line CL directly disposed on the display panel 100 is relatively bigger than that of the signal line SL and thus, the load of the connection line CL in a boundary area BA between the first, second, third and fourth areas A1, A2, A3 and A4 increases. Thus, a luminance difference due to a load increase may occur in the boundary area BA.

Generally, a luminance of the boundary area BA according to the load increase of the connection line CL is more dark in an upper portion UA in the boundary area BA than a central portion in each of areas A1, A2, A3 and A4, and is more bright in a lower portion LA in the boundary BA than the central portion in each of areas A1, A2, A3 and A4. For example, as shown in FIG. 4B, the upper portion UA in the boundary BA including a last gate line GLk-1 of the second area A2 is darker than the second area A2 and the lower portion LA in the boundary BA including a first gate line GLk of the third area A3 is brighter than the third area A3.

According to an exemplary embodiment of the inventive concept, a charging rate difference locally occurring according to a discontinuous load change of the display apparatus may be compensated. At least one of the pulse-width and the phase of the second reference control signal CPV2 corresponding to the predetermined horizontal line having a charging rate difference may be adjusted such that the charging rate difference of the predetermined horizontal line is compensated.

Figure 5A:
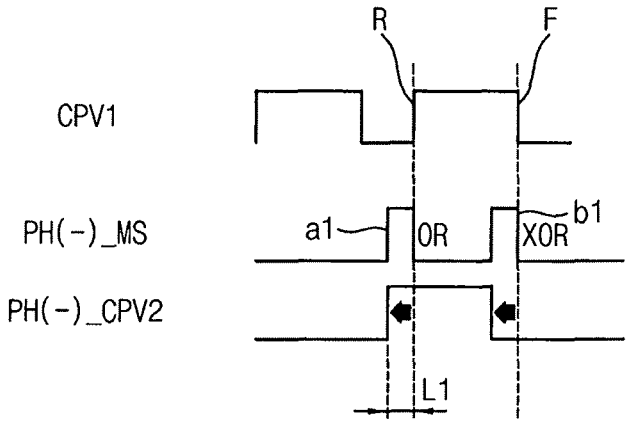
FIGS. 5A and 5B are conceptual diagrams illustrating a method of generating a second reference signal of the timing controller according to an exemplary embodiment of the inventive concept.
Figure 5B:
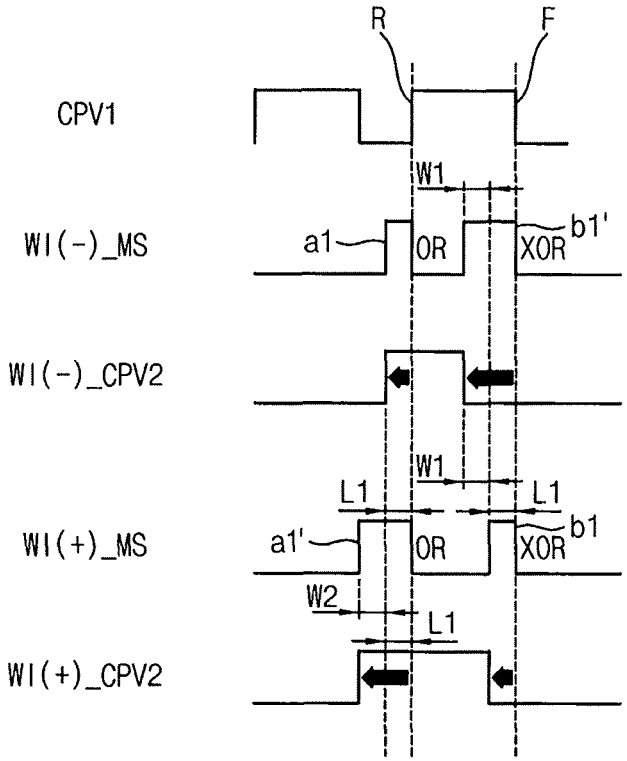
Figure 6A:
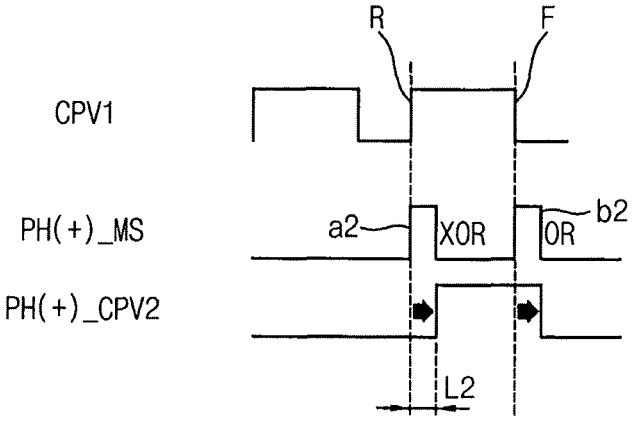
FIGS. 6A and 6B are conceptual diagrams illustrating a method of generating a second reference signal of the timing controller according to an exemplary embodiment of the inventive concept.
Figure 6B:
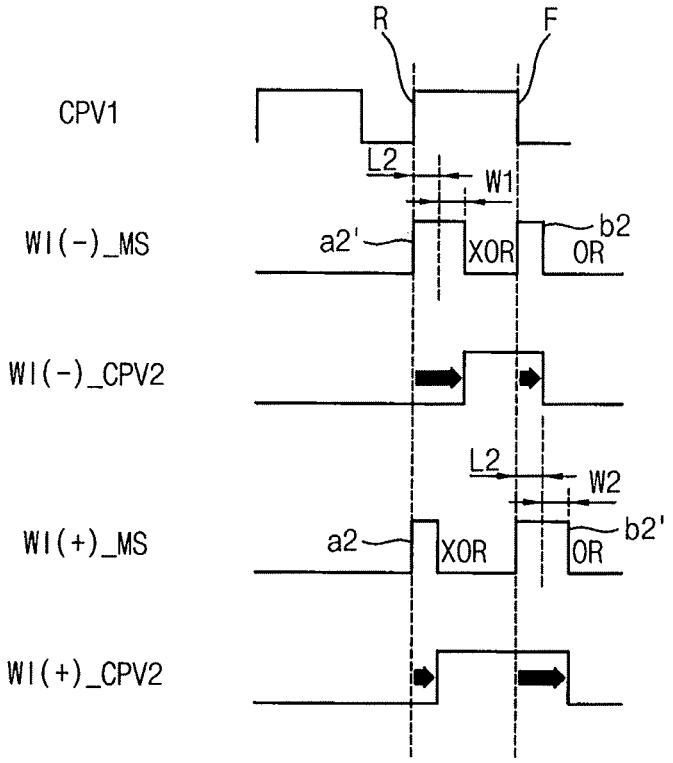

FIGS. 5A and 5B are conceptual diagrams illustrating a method of generating a second reference signal of the timing controller according to an exemplary embodiment of the inventive concept. FIGS. 6A and 6B are conceptual diagrams illustrating a method of generating a second reference signal of the timing controller according to an exemplary embodiment of the inventive concept.

Referring to FIG. 5A, in order to generate a second reference control signal PH(−)_CPV2 which has been phase shifted to the left by a first length L1 with respect to a first reference control signal CPV1, a masking signal PH(−)_MS includes a first rising masking pulse a1 which has a falling period in synchronization with a rising period R of the first reference control signal CPV1 and a first falling masking pulse b1 which has a falling period in synchronization with a falling period F of the first reference control signal CPV1. The first rising masking pulse a1 and the first falling masking pulse b1 have a pulse width that are substantially the same as the first length L1.

An OR operation is performed on the first reference control signal CPV1 and the first rising masking pulse a1 and a XOR operation is performed on the first reference control signal CPV1 and the first falling masking pulse b1. Thus, the second reference control signal PH(−)_CPV2 which has been phase shifted to the left by the first length L1 is generated.

Referring to FIG. 5B, in order to generate a second reference control signal WI(−)_CPV2 which has been phase shifted to the left by a first length L1 and has had its pulse width decreased by a first width W1 with respect to a first reference control signal CPV1, a masking signal WI(−)_MS includes a first rising masking pulse a1 which has a falling period in synchronization with a rising period R of the first reference control signal CPV1 and a first falling masking pulse b1' which has a falling period in synchronization with a falling period F of the first reference control signal CPV1. The first rising masking pulse a1 has a pulse width substantially the same as the first length L1 and the first falling masking pulse b1' has a pulse width substantially the same as a sum of the first length L1 and the first width W1.

The OR operation is performed on the first reference control signal CPV1 and the first rising masking pulse a1, and the XOR operation is performed on the first reference control signal CPV1 and the first falling masking pulse b1'. Thus, the second reference control signal WI(−)_CPV2 which has been phase shifted to the left by the first length L1 and has had its pulse width decreased by the first width W1 with respect to a first reference control signal CPV1, is generated.

In addition, in order to generate a second reference control signal WI(+)_CPV2 which has been phase shifted to the left by a first length L1 and has had its pulse width increased by a second width W2 with respect to the first reference control signal CPV1, a masking signal WI(+)_MS includes a first rising masking pulse a1' which has a falling period in synchronization with a rising period R of the first reference control signal CPV1 and a first falling masking pulse b1 which has a falling period in synchronization with a falling period F of the first reference control signal CPV1. The first rising masking pulse a1' has a pulse width substantially the same as a sum of the first length L1 and the second width W2, and the first falling masking pulse b1 has a pulse width substantially the same as the first length L1.

The OR operation is performed on the first reference control signal CPV1 and the first rising masking pulse a1', and the XOR operation is performed on the first reference control signal CPV1 and the first falling masking pulse b1. Thus, the second reference control signal WI(+)_CPV2 which has been phase shifted to the left by a first length L1 and has had its pulse width increased by a second width W2 with respect to the first reference control signal CPV1, is generated.

Referring to FIG. 6A, in order to generate a second reference control signal PH(+)_CPV2 which has been phase shifted to the right by a second length L2 with respect to a first reference control signal CPV1, a masking signal PH(+)_MS includes a second rising masking pulse a2 which has a rising period in synchronization with a rising period R of the first reference control signal CPV1 and a second falling masking pulse b2 which has a rising period in synchronization with a falling period F of the first reference control signal CPV1. The second rising masking pulse a2 and the second falling masking pulse b2 have a pulse width substantially the same as the second length L2.

The XOR operation is performed on the first reference control signal CPV1 and the second rising masking pulse a2, and the OR operation is performed on the first reference control signal CPV1 and the second falling masking pulse b2. Thus, the second reference control signal PH(+)_CPV2 which has been phase shifted to the right by the second length L2, is generated.

Referring to FIG. 6B, in order to generate a second reference control signal WI(−)_CPV2 which has been phase shifted to the right by a second length L2 and has had its pulse width decreased by a first width W1 with respect to a first reference control signal CPV1, a masking signal WI(−)_MS includes a second rising masking pulse a2' which has a rising period in synchronization with a rising period R of the first reference control signal CPV1 and a second falling masking pulse b2 which has a rising period in synchronization with a falling period F of the first reference control signal CPV1. The second rising masking pulse a2' has a pulse width substantially the same as a sum of the second length L2 and the first width W1 and the second falling masking pulse b2 has a pulse width substantially the same as the second length L2.

The XOR operation is performed on the first reference control signal CPV1 and the second rising masking pulse a1', and the OR operation is performed on the first reference control signal CPV1 and the second falling masking pulse b2. Thus, a second reference control signal WI(−)_CPV2 which has been phase shifted to the right by the second length L2 and has had its pulse width decreased by a first width W1 with respect to a first reference control signal CPV1, is generated.

In addition, in order to generate a second reference control signal WI(+)_CPV2 which has been phase shifted to the right by a second length L2 and has its pulse width increased by a second width W2 with respect to the first reference control signal CPV1, a masking signal WI(+)_MS includes a second rising masking pulse a2 which has a rising period in synchronization with a rising period R of the first reference control signal CPV1 and a second falling masking pulse b2' which has a rising period in synchronization with a falling period F of the first reference control signal CPV1. The second rising masking pulse a2 has a pulse width substantially the same as the second length L2 and the second falling masking pulse b2' has a pulse width substantially the same as a sum of the second length L2 and the second width W2.

The XOR operation is performed on the first reference control signal CPV1 and the second rising masking pulse a2 via, and the OR operation is performed on the first reference control signal CPV1 and the second falling masking pulse b2'. Thus, the second reference control signal WI(+) CPV2 which has been phase shifted to the right by the second length L2 and has had its pulse width increased by the second width W2 with respect to the first reference control signal CPV1, is generated.

Figure 7:
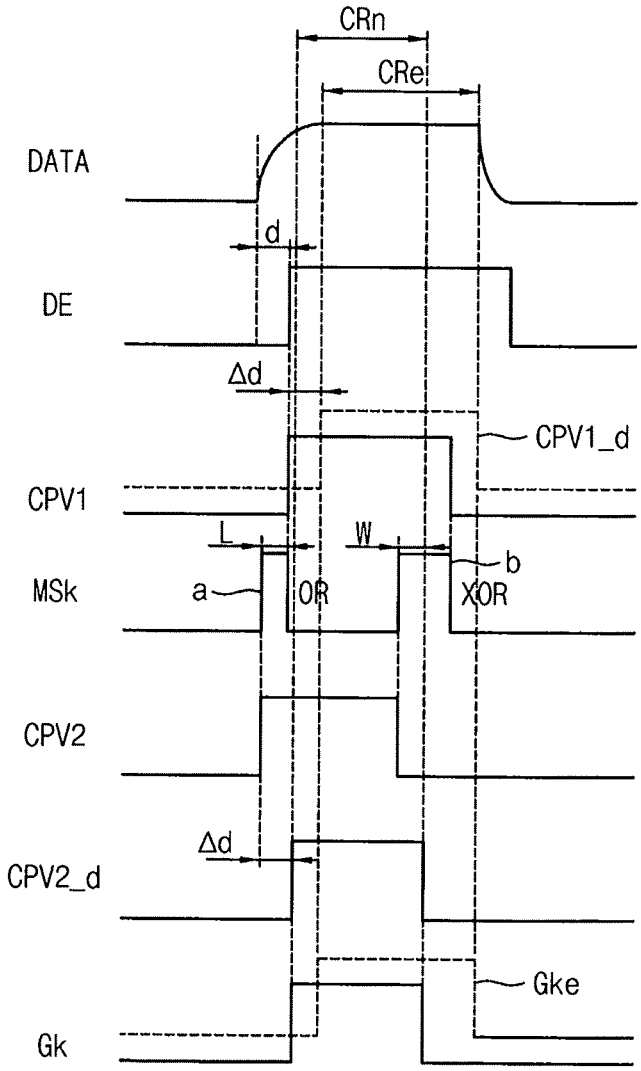
FIG. 7 is a waveform diagram illustrating a method of driving a display apparatus according to an exemplary embodiment of the inventive concept.

FIG. 7 is a waveform diagram illustrating a method of driving a display apparatus according to an exemplary embodiment of the inventive concept.

Referring to FIGS. 1, 2, 4A and 7, a method of compensating a charging rate difference which occurs on a k-th horizontal line corresponding to a k-th gate line GLk being a first gate line in the third area A3 of the display panel 100, is explained.

The data driver circuit 250 is configured to output a data signal DATA of the k-th horizontal line corresponding to the k-th gate line GLk. The data signal DATA has a phase difference with a k-th gate signal applied to the k-th gate line GLk due to the RC time delay of the data line DL. Thus, the data enable signal DE may be delayed by a period d based on the RC time delay of the data line.

The first reference control signal generator 220 is configured to generate a first reference control signal CPV1 based on the data enable signal DE.

The masking signal generator 255 is configured to generate a masking signal MSk using the masking parameter for the k-th horizontal line stored in the memory 240 based on a horizontal line count value received from the horizontal line counter 230. The masking parameter for the k-th horizontal line includes a rising parameter and a falling parameter. The masking signal MSk includes a rising masking pulse a corresponding to the rising parameter and a falling masking pulse b corresponding to the falling parameter.

The second reference control signal generator 245 is configured to generate a second reference control signal CPV2 having at least one of a pulse-width and a phase which are adjusted using the rising masking pulse a and the falling masking pulse b of the masking signal MSk based on the first reference control signal CPV1. Based on the first reference control signal CPV1, the second reference control signal CPV2 has been phase shifted to a left by a length L and has had its pulse width decreased by a width W.

The second reference control signal CPV2 having at least one of a pulse-width and a phase adjusted, is transferred to a third gate circuit film GCF3 which drives the gate lines in the third area A3 corresponding to the k-th horizontal line. The second reference control signal CPV2 is transferred to the third gate circuit film GCF3 through the control signal line CSL disposed on the gate circuit films and the display panel. Thus, the second reference control signal CPV2 is delayed by a period Δd according to an RC time delay of the control signal line CSL having a discontinuous load change, and then is transferred to the third gate circuit film GCF3.

The rising parameter and the falling parameter are preset values for compensating a phase difference of the k-th gate signal based on the period Δd according to the discontinuous load change. In addition, the rising parameter and the falling parameter are preset values for compensating a charging rate difference between the k-th horizontal line and at least one horizontal line adjacent to the k-th horizontal line.

In the exemplary embodiment, the pulse width and the phase of the second reference control signal CPV2 for the k-th horizontal line are all adjusted, but not limited thereto. One of the pulse-width and the phase of the second reference control signal CPV2 is adjusted such that the charging rate difference according to the discontinuous load change may be removed.

Therefore, a gate driver chip disposed on the third gate circuit film GCF3 may receive a second reference control signal CPV2_d delayed by the period Δd from the second reference control signal CPV2 generated from the second reference control signal generator 245. Then, a k-th gate signal Gk in synchronization with the second reference control signal CPV2_d is applied to the k-th gate signal Gk. The k-th horizontal line including the pixels connected to the k-th gate line GLk has a first data charging rate CRn corresponding to an overlapping portion in which the data signal DATA overlaps with the k-th gate signal Gk.

However, a second data charging rate CRe based on the first reference control signal CPV1 according to a comparative example embodiment is explained.

The first reference control signal CPV1 generated from the first reference control signal generator 220 is transferred to the third gate circuit film GCF3 through the control signal line CSL disposed on the gate circuit films and the display panel. Thus, the first reference control signal CPV1 is delayed by the period Δd according to an RC time delay of the control signal line CSL having a discontinuous load change, and then is transferred to the third gate circuit film GCF3.

Therefore, a gate driver chip disposed on the third gate circuit film GCF3 may receive a first reference control signal CPV1_d delayed by the period Δd from the first reference control signal CPV1 generated from the first reference control signal generator 220. Then, a k-th gate signal Gke in synchronization with the first reference control signal CPV1_d is applied to the k-th gate signal Gk. The k-th horizontal line including the pixels connected to the k-th gate line GLk has a second data charging rate CRe corresponding to an overlapping portion in which the data signal DATA overlaps with the k-th gate signal Gke. The second data charging rate CRe is more than the first data charging rate CRn.

As described above, when the k-th horizontal line is driven based on the first reference control signal CPV1 without concerned for the discontinuous load change, the overlapping portion (data charging rate) of the data signal and the gate signal for driving the k-th horizontal line is different from that of an adjacent horizontal line and thus, a luminance difference may occur.

According to an exemplary embodiment of the inventive concept, a charging rate difference locally occurring according to a discontinuous load change of the display apparatus may be compensated. At least one of the pulse-width and the phase of the reference control signal corresponding to the predetermined horizontal line on which the charging rate difference occurs, may be adjusted and thus, the luminance difference according to the charging rate difference may be removed.

Figure 8:
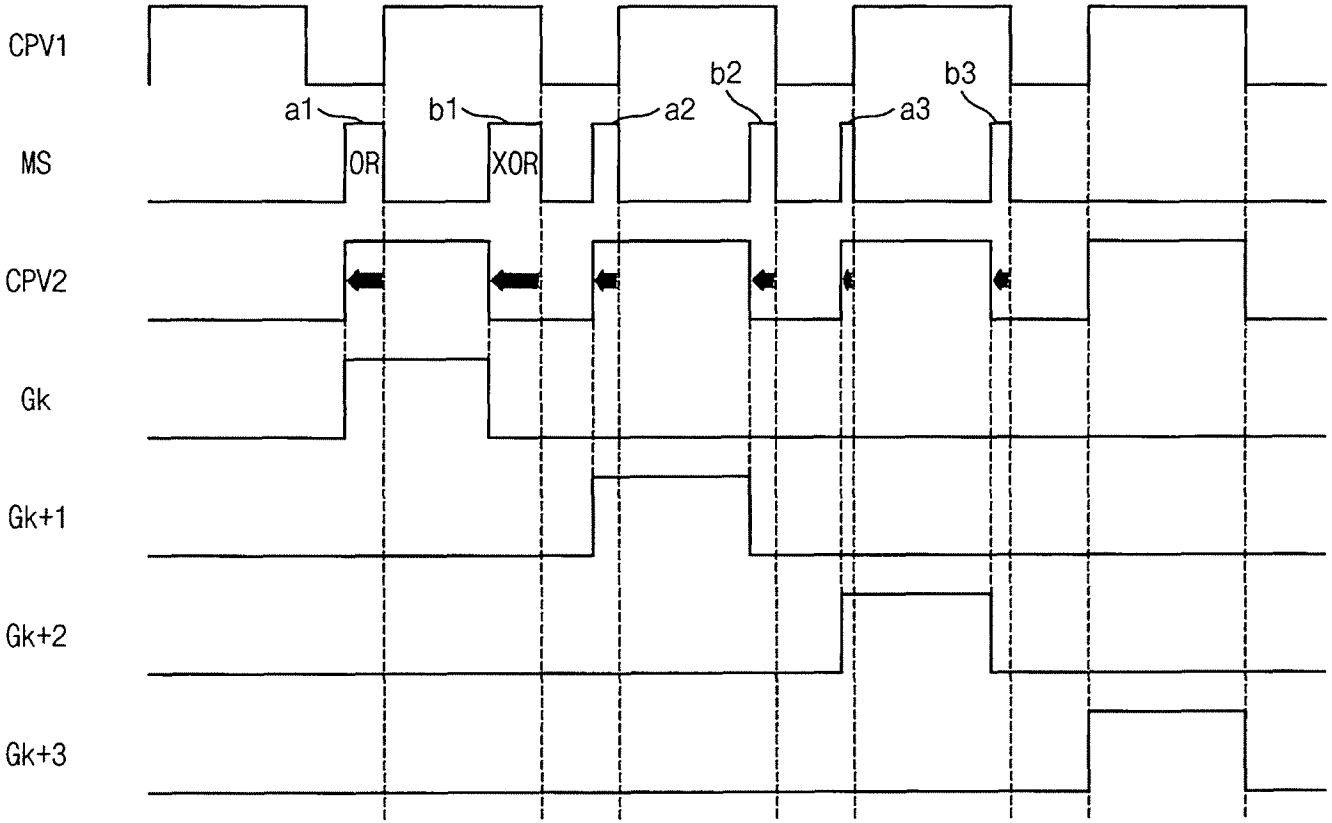
FIG. 8 is a waveform diagram illustrating a method of driving a display apparatus according to an exemplary embodiment of the inventive concept.

FIG. 8 is a waveform diagram illustrating a method of driving a display apparatus according to an exemplary embodiment of the inventive concept.

Referring to FIGS. 1, 2, 4A and 8, a method of compensating a charging rate difference which occurs on a k-th horizontal line corresponding to a k-th gate line GLk being a first gate line in the third area A3 of the display panel 100, is explained.

The first reference control signal generator 220 is configured to generate a first reference control signal CPV1 based on the data enable signal DE.

The masking signal generator 255 is configured to generate a masking signal MS using masking parameters for the k-th horizontal line and a plurality of horizontal lines, for example, (k+1)-th and (k+2)-th horizontal lines stored in the memory 240 based on a horizontal line count value received from the horizontal line counter 230.

The masking signal generator 255 generates a first rising masking pulse a1 and a first falling masking pulse b1 using a first masking parameter corresponding to the k-th horizontal line, generates a second rising masking pulse a2 and a second falling masking pulse b2 using a second masking parameter corresponding to the (k+1)-th horizontal line and generates a third rising masking pulse a3 and a third falling masking pulse b3 using a third masking parameter corresponding to the (k+2)-th horizontal line. The first, second and third masking parameters may be gradually increased or decreased based on the first masking parameter and may be stored in the memory 240. Alternatively, the first, second and third masking parameters may be calculated into gradually increased or decreased values using the first masking parameter.

The second reference control signal generator 245 is configured to calculate the second reference control signal CPV2 by performing the OR and XOR operations on the masking signal MS and the first reference control signal CPV1.

For example, as shown in FIG. 8, the OR operation is performed on the first rising masking pulse a1 and a corresponding rising period of the first reference control signal CPV1, and the XOR operation is performed on the first falling masking pulse b1 and a corresponding falling period of the first reference control signal CPV1. Thus a second reference control signal CPV2 for the k-th horizontal line may be generated. The second reference control signal CPV2 for the k-th horizontal line has its phase and pulse width adjusted based on the first reference control signal CPV1.

The OR operation is performed on the second rising masking pulse a2 having a pulse width smaller than the first rising masking pulse a1 and a corresponding rising period of the first reference control signal CPV1, and the XOR operation is performed on the second falling masking pulse b2 having a pulse width smaller than the first falling masking pulse b1 and a corresponding falling period of the first reference control signal CPV1, and thus a second reference control signal CPV2 for the (k+1)-th horizontal line may be generated. The second reference control signal CPV2 for the (k+1)-th horizontal line has its phase and pulse width adjusted based on the first reference control signal CPV1.

The OR operation is performed on the third rising masking pulse a3 having a pulse width smaller than the second rising masking pulse a2 and a corresponding rising period of the first reference control signal CPV1, the XOR operation is performed on the third falling masking pulse b3 having a pulse width smaller than the second falling masking pulse b2 and a corresponding falling period of the first reference control signal CPV1, and thus a second reference control signal CPV2 for the (k+2)-th horizontal line may be generated. The second reference control signal CPV2 for the (k+2)-th horizontal line has its phase and pulse width adjusted based on the first reference control signal CPV1.

The second reference control signal CPV2 having an adjusted phase and pulse width corresponding to the k-th horizontal line and the plurality of horizontal lines adjacent to the k-th horizontal line, is transferred to the third gate circuit film GCF3 through the control signal line CSL disposed on the gate circuit films and the display panel.

The gate driver chip disposed on the third gate circuit film GCF3 is configured to generate a plurality of gate signals Gk, Gk+1, Gk+1 and Gk+3 in synchronization with the second reference control signal CPV2 and to provide the gate lines in the third area A3 with the gate signals Gk, Gk+1, Gk+1 and Gk+3. For example, each pulse of the second reference control signal CPV2 may correspond to a distinct gate signal of the third area A3. For example, a pulse of a gate signal of the third area A3 may start and end when a pulse of the second reference control signal CPV2 starts and ends.

As described above, phases and pulse widths of the reference control signal respectively corresponding to the k-th horizontal line having a charging rate difference and the horizontal lines adjacent to the k-th horizontal line, are adjusted and thus, the charging rate difference may be gradually decreased or increased. The adjacent horizontal lines may include previous horizontal lines (for example, (k−1)-th, (k−2)-th, etc.) based on the k-th horizontal line.

Figure 9:
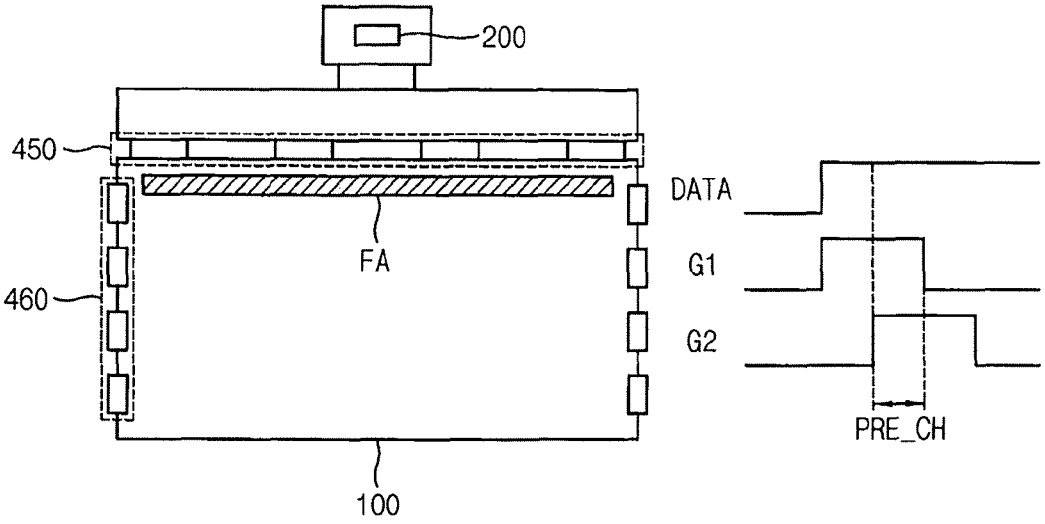
FIG. 9 is a plan view illustrating a display apparatus according to an exemplary embodiment of the inventive concept.

FIG. 9 is a plan view illustrating a display apparatus according to an exemplary embodiment of the inventive concept.

Hereinafter, the same reference numerals are used to refer to the same or like parts as those described in the previous exemplary embodiments, and the same detailed explanations are not repeated unless necessary.

Referring to FIG. 9, the display apparatus includes a display panel 100, a data driver circuit 450 and a gate driver circuit 460 driving the display panel 100. The display apparatus may include a timing controller 200 as shown in FIG. 2.

The gate driver circuit 460 is configured to generate the gate signal for a pre-charge driving mode. For example, an early portion PRE_CH of a second gate signal G2 applied to a current gate line overlaps with a late portion of a first gate signal applied to a previous gate line. For example, during the pre-charge mode, a first part of a pulse of the second gate signal G2 overlaps with a second part of a pulse of the first gate signal G1. Thus, a current horizontal line is pre-charged by a data signal of a previous horizontal line such that a data charging rate may be increased.

According to the pre-charge driving mode, a first horizontal line of the display panel 100 is not driven with the pre-charge driving mode because a previous gate line of a first gate line does not exist. The first horizontal line has a low data charging rate and thus, the first horizontal line has a luminance darker than adjacent horizontal lines. When the display apparatus is driven with the pre-charge driving mode, an uppermost area of the display panel 100 is relatively dark.

According to an exemplary embodiment of the inventive concept, in the display apparatus driven with the pre-charge driving mode, the timing controller 200 is configured to generate a second reference control signal having at least one of the phase and the pulse-width gradually changed corresponding to the first horizontal line and at least one adjacent horizontal line adjacent to the first horizontal line in order to compensate for the charging rate difference of the first horizontal line.

Masking parameters for generating the second reference control signal corresponding to the first horizontal line and the adjacent horizontal line may be preset to have a data charging rate without a display defect such as a luminance difference. As described referring to FIGS. 5A to 6B, at least one of the phase and the pulse-width of the second reference control signal may be adjusted using the masking parameter.

Therefore, the display defect such as the luminance difference due to the charging rate difference occurring on the first horizontal line may be removed.

Figure 10:
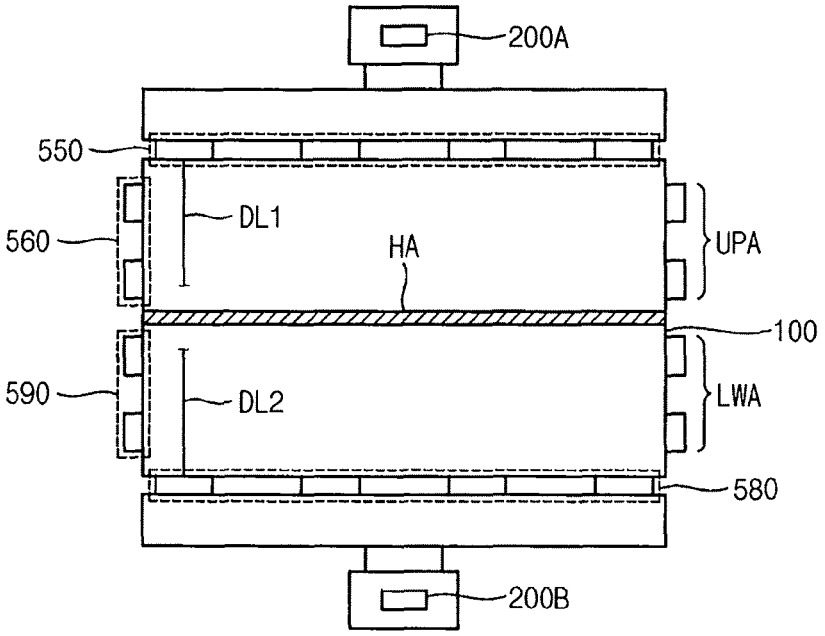
FIG. 10 is a plan view illustrating a display apparatus according to an exemplary embodiment of the inventive concept.

FIG. 10 is a plan view illustrating a display apparatus according to an exemplary embodiment of the inventive concept.

Hereinafter, the same reference numerals are used to refer to the same or like parts as those described in the previous exemplary embodiments, and the same detailed explanations are not repeated unless necessary.

Referring to FIG. 10, the display apparatus includes a display panel 100 which is divided into an upper area UPA and a lower area LWA, a plurality of first data lines DL1 which is disposed in the upper area UPA and a plurality of second data lines DL2 which is spaced apart from the first data lines DL1 and disposed in the lower area LWA. The display apparatus includes a first data driver circuit 550 which drives the first data lines DL1 in the upper area UPA, a first gate driver circuit 560 which drives the gate lines in the upper area UPA, a second data driver circuit 580 which drives the second data lines DL2 in the lower area LWA and a second gate driver circuit 590 which drives the gate lines in the lower area LWA.

In addition, the display apparatus includes a first timing controller 200A which controls the first data driver circuit 550 and the first gate driver circuit 560 and a second timing controller 200B which controls the second data driver circuit 580 and the second gate driver circuit 590. The first and second timing controllers 200A and 200B include the same or like parts as the timing controller 200 described in the previous exemplary embodiments as shown in FIG. 2.

According to an exemplary embodiment of the inventive concept, the upper area UPA and the lower area LWA of the display panel 100 are separately driven. For example, the first timing controller 200A drives the upper area UPA and the second timing controller 200B drives the lower area LWA. Thus, a luminance difference being dark or bright may occur in a half area HA which is a boundary area between the upper area UPA and lower area LWA.

According to an exemplary embodiment of the inventive concept, at least one of the first and second timing controllers 200A and 200B may be configured to gradually change a charge rate difference of the half area HA. Therefore, the display defect due to the charging rate difference which occurs on a predetermined horizontal line in the half area HA may be removed.

A method of gradually changing the charging rate difference is the same or like as those described in the previous exemplary embodiments. At least one of the first and second timing controllers 200A and 200B is configured to generate a second reference control signal having at least one of its phase and pulse-width gradually changed corresponding to the half area HA using masking parameters for the plurality horizontal lines in the half area HA including a predetermined horizontal line having the charging rate difference. A plurality gate signals applied to a plurality gate lines in the half area HA is generated based on the second reference control signal and thus, the display defect due to the charging rate difference in the half area HA may be removed.

As described above, according to at least one exemplary embodiment of the inventive concept, the reference control signal controlling the gate signal is locally adjusted corresponding to the predetermined horizontal line having the luminance difference to locally adjust the charge rate difference of the predetermined horizontal line such that the display defect due to the luminance difference may be removed.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A display apparatus comprising:

a display panel divided into an upper area and a lower area, the display panel comprising a plurality of gate lines, a plurality of first data lines disposed in the upper area and a plurality of second data lines disposed in the lower area spaced apart from the first data lines;

first and second gate driver circuits are configured to generate a plurality of gate signals sequentially applied to the gate lines;

a first timing controller is configured to control the upper area; and a second timing controller is configured to control the lower area, wherein at least one of the timing controllers is configured to generate a reference control signal based on a masking signal derived from a count value of a predetermined gate line among the gate lines receiving a predetermined gate signal among the gate signals, and to output the reference control signal to at least one of the gate driver circuits to adjust at least one of a pulse-width and a phase of the predetermined gate signal, wherein at least one of the timing controllers is configured to gradually adjust at least one of pulse-widths and phases of the predetermined gate signal applied to the predetermined gate line in a boundary area between the upper and lower areas and an adjacent gate signal applied to at least one of the gate lines adjacent to the predetermined gate line.

2. The display apparatus of claim 1, wherein at least one of the timing controllers performs the gradual adjusts using the reference control signal.

3. The display apparatus of claim 1, wherein at least one of the timing controllers comprises:

a first reference control signal generator is configured to generate a first reference control signal based on a data enable signal;

a masking signal generator is configured to generate the masking signal having a rising masking pulse and a falling masking pulse; and a second reference control signal generator is configured to perform an operation on the first reference control signal and the masking signal to generate a second reference control signal locally adjusted with respect to the first reference control signal.

4. The display apparatus of claim 3, wherein the second reference control signal generator is configured to perform an OR or XOR operation on a rising period of the first reference control signal and the rising masking pulse and to perform an OR or XOR operation on a falling period of the first reference control signal and the falling masking pulse, to generate the second reference control signal.

5. The display apparatus of claim 3, wherein a horizontal blanking period of the data enable signal is delayed based on a resistance-capacitance RC time delay of a data line.

6. The display apparatus of claim 3, wherein the timing controller comprises:

a horizontal line counter is configured to count a data enable signal to generate the count value corresponding to the predetermined gate line receiving the predetermined gate signal; and a memory is configured to store a rising parameter for generating the rising masking pulse and a falling parameter for generating the falling masking pulse.

7. The display apparatus of claim 6, wherein the rising parameter and the falling parameter are preset to compensate a charging rate difference in a predetermined area corresponding to the predetermined gate line.

8. The display apparatus of claim 3, wherein one of the first and second gate driver circuits is configured to generate a gate signal, wherein an earlier portion of a pulse of the gate signal overlaps with a later portion of a pulse of a previous gate signal, and at least one of the timing controllers is configured to generate the second reference control signal gradually adjusting at least one of pulse-widths and phases of a first gate signal applied to a first gate line and an adjacent gate signal applied to at least one gate line adjacent to the first gate line.

9. A method of driving a display apparatus comprising:

generating, by at least one of a first timing controller and a second timing controller, a reference control signal based on a masking signal derived from a count value of a predetermined gate line of a display panel of the display apparatus;

outputting, by at least one of the timing controllers, the reference control signal to at one of a first gate driver circuit and a second gate driver circuit;

generating, by the at least one gate driver circuit, a predetermined gate signal for the predetermined gate line; and adjusting, by the at least one gate driver circuit, at least one of a pulse-width and a phase of the gate signal based on the reference control signal, wherein the display panel is divided into an upper area controlled by the first timing controller and a lower area controlled by the second timing, a plurality of first data lines is disposed in the upper area, and a plurality of second data lines spaced apart from the first data lines is disposed in the lower area, wherein the adjusting comprises gradually adjusting at least one of pulse-widths and phases of the predetermined gate signal applied to the predetermined gate line in a boundary area between the upper and lower areas and an adjacent gate signal applied to at least one gate line adjacent the predetermined gate line.

10. The method of claim 9, further comprising:

generating a first reference control signal based on a data enable signal;

generating the masking signal having a rising masking pulse and a falling masking pulse; and performing an operation on the first reference control signal and the masking signal to generate a second reference control signal locally adjusted with respect to the first reference control signal.

11. The method of claim 10, the performing of the operation comprising:

performing an OR or XOR operation on a rising period of the first reference control signal and the rising masking pulse; and performing an OR or XOR operation on a falling period of the first reference control signal and the failing masking pulse.

12. The method of claim 10, wherein a horizontal blanking period of the data enable signal is delayed based on a resistance-capacitance RC time delay of a data line.

13. The method of claim 10, further comprising:

counting the data enable to signal to output the count value;

outputting a rising parameter and a falling parameter corresponding to the predetermined gate line from a memory based on the count value; and generating the masking signal using the rising parameter and the falling parameter.

14. The method of claim 13, wherein the rising parameter and the falling parameter are preset to compensate a charging rate difference in a predetermined area corresponding to the predetermined gate line.

15. The method of claim 10, further comprising:

generating a gate signal having an early period overlapping with a late period of a previous gate signal; and gradually adjusting at least one of pulse widths and phases of a first gate signal applied to a first gate line and an adjacent gate signal applied to at least one gate line adjacent to the first gate line using the second reference control signal.

* * * * *